US009624087B2

(12) United States Patent
Tuyls et al.

(10) Patent No.: US 9,624,087 B2
(45) Date of Patent: Apr. 18, 2017

(54) ENVIRONMENTALLY FRIENDLY FLUID DISPENSING SYSTEM

(75) Inventors: James M. Tuyls, Vacaville, CA (US); Thomas R. Hecht, Winters, CA (US); Donald A. Klotz, Vacaville, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 830 days.

(21) Appl. No.: 12/814,299

(22) Filed: Jun. 11, 2010

(65) Prior Publication Data

US 2010/0314411 A1 Dec. 16, 2010

Related U.S. Application Data

(60) Provisional application No. 61/186,482, filed on Jun. 12, 2009.

(51) Int. Cl.

| | |
|---|---|
| ***B67D 7/06*** | (2010.01) |
| ***B67D 7/02*** | (2010.01) |
| ***B67D 7/04*** | (2010.01) |
| ***B67D 7/08*** | (2010.01) |
| ***B67D 7/32*** | (2010.01) |
| ***B67D 7/42*** | (2010.01) |
| ***B67D 7/72*** | (2010.01) |

(52) U.S. Cl.

CPC ..... *B67D 7/02* (2013.01); *B67D 7/0238* (2013.01); *B67D 7/0478* (2013.01); *B67D 7/08* (2013.01); *B67D 7/3209* (2013.01); *B67D 7/425* (2013.01); *B67D 7/426* (2013.01); *B67D 7/428* (2013.01); *B67D 7/72* (2013.01)

(58) Field of Classification Search

CPC ..... B67D 7/02; B67D 7/0238; B67D 7/08; B67D 7/425; B67D 7/426; B67D 7/428; B67D 7/52; B67D 7/04; B67D 7/0476–7/0486

USPC ..... 222/144.5, 145.1, 132, 129, 136, 394, 222/389, 135, 334, 386.5

See application file for complete search history.

(56) References Cited

U.S. PATENT DOCUMENTS

| | | | | |
|---|---|---|---|---|
| 2,937,792 A * | 5/1960 | Firstenberg | B67D 1/0084 | 222/144.5 |
| 3,144,967 A * | 8/1964 | McClain | 222/144.5 | |
| 3,168,967 A * | 2/1965 | Giampa | 222/129.1 | |
| 3,216,445 A * | 11/1965 | Cornelius | B67D 1/1472 | 137/594 |
| 3,590,890 A * | 7/1971 | Young | 141/192 | |
| 3,664,552 A * | 5/1972 | Carse | B67D 1/0084 | 222/144.5 |

(Continued)

*Primary Examiner* — Patrick M Buechner
*Assistant Examiner* — Randall Gruby
(74) *Attorney, Agent, or Firm* — Kilpatrick Townsend & Stockton LLP

(57) ABSTRACT

Environmental friendly automotive fluid dispensing systems and are provided. One disclosed system provides for the controlled dispensing of an automotive fluid selected from multiple automotive fluids. A quantity of fluid to be dispensed can be designated and the system can dispense the designated quantity of the selected fluid. A pump assembly is used to transfer automotive fluid from a selected container to a dispensing gun in a controlled fashion. The product dispensing gun can include a check valve for preventing fluid from exiting the dispensing gun when no fluid is being transferred to the dispensing gun by the pump assembly.

9 Claims, 16 Drawing Sheets

(56) References Cited

U.S. PATENT DOCUMENTS 3,690,557 A * 9/1972 Higgins ..... B29B 7/7438 239/112
3,703,187 A * 11/1972 Booth ..... A47J 31/46 137/114
3,991,911 A * 11/1976 Shannon ..... B67D 1/0041 222/129.4
4,031,930 A * 6/1977 Sutcliffe ..... B67D 7/48 141/207
4,083,474 A * 4/1978 Waite ..... B05B 7/1209 137/114
4,162,028 A * 7/1979 Reichenberger ..... B67D 1/0041 200/5 R
4,163,510 A * 8/1979 Strenger ..... A47J 31/407 222/129.2
4,276,999 A * 7/1981 Reichenberger ..... B67D 1/0041 222/129.4
4,433,795 A * 2/1984 Maiefski et al. ..... 222/14
4,732,300 A * 3/1988 Valiyee ..... B67D 1/0084 222/144.5
4,889,148 A * 12/1989 Smazik ..... B67D 1/0037 137/1
4,921,140 A * 5/1990 Belcham ..... 222/144.5
4,938,387 A * 7/1990 Kervefors ..... B67D 1/0016 141/376
4,955,544 A * 9/1990 Kopp ..... B29B 7/7438 137/898
4,978,029 A * 12/1990 Furrow et al. ..... 222/1
5,018,645 A * 5/1991 Zinsmeyer ..... 222/14
5,184,309 A * 2/1993 Simpson et al. ..... 700/283
5,377,729 A * 1/1995 Reep ..... B67D 7/52 141/206
5,462,204 A * 10/1995 Finn ..... B05B 1/3066 222/137
5,603,364 A * 2/1997 Kerssies ..... B67D 7/48 141/206
5,683,544 A * 11/1997 Kopp ..... B01F 5/0665 156/578
5,779,147 A * 7/1998 Rosse ..... B65B 39/001 137/853
5,887,756 A * 3/1999 Brown ..... B05B 1/3046 222/136
6,019,146 A * 2/2000 Taylor ..... 141/59
6,041,965 A * 3/2000 Smith ..... 222/25
6,158,624 A * 12/2000 Grigg ..... B01F 13/0027 222/145.6
6,223,788 B1 * 5/2001 Taylor ..... 141/9
6,345,776 B1 * 2/2002 Hurray ..... B29B 7/7438 222/137
6,357,632 B1 * 3/2002 Salmela ..... B67D 7/02 222/334
6,443,335 B1 * 9/2002 Pinedjian et al. ..... 222/504
6,557,733 B1 * 5/2003 Durham ..... 222/144.5
6,592,008 B2 * 7/2003 Dion ..... 222/135
7,147,015 B1 * 12/2006 Durham ..... 141/105
7,581,572 B1 * 9/2009 Sutera ..... B67D 7/42 137/527.6
7,607,459 B2 * 10/2009 Treen, Jr. ..... B67D 7/52 141/311 A
8,171,965 B2 * 5/2012 Burris ..... B67D 7/52 141/311 A
8,579,160 B2 * 11/2013 McMichael ..... B05B 7/12 222/132
2001/0037839 A1 * 11/2001 Litt ..... 141/234
2003/0062380 A1 * 4/2003 Boyle ..... B67D 7/145 222/14
2008/0035239 A1 * 2/2008 Treen ..... B67D 7/52 141/206
2008/0223876 A1 * 9/2008 Schroeder ..... 222/144.5
2008/0308178 A1 * 12/2008 Foster et al. ..... 141/192
2009/0005903 A1 * 1/2009 Winsness ..... 700/239
2009/0008407 A1 * 1/2009 Sevcik ..... B67D 1/0021 222/1
2009/0084817 A1 * 4/2009 Schroeder et al. ..... 222/144.5
2009/0314797 A1 * 12/2009 Breeser ..... B67D 7/04 222/14
2010/0314411 A1 * 12/2010 Tuyls ..... B67D 7/02 222/144.5
2011/0073617 A1 * 3/2011 Martindale et al. ..... 222/144.5
2011/0220244 A1 * 9/2011 Varini ..... 141/392
2013/0008536 A1 * 1/2013 Wrobel et al. ..... 137/565.01
2014/0034675 A1 * 2/2014 Santy ..... 222/144.5
2014/0130939 A1 * 5/2014 Kunter ..... B67D 7/48 141/198
2016/0167942 A1 * 6/2016 Cornett ..... B67D 7/54 141/1

* cited by examiner

STANDBY MODE

TOTALS DISPLAY MODE

PRODUCT POSITION ASSIGNMENT MODE

ENVIRONMENTALLY FRIENDLY FLUID DISPENSING SYSTEM

CROSS-REFERENCES TO RELATED APPLICATIONS

The present application claims priority to U.S. Provisional Patent Application No. 61/186,482, entitled "Environmentally Friendly Fluid Dispensing System," filed on Jun. 12, 2009, the entire disclosure of which is incorporated herein by reference.

BACKGROUND

Various embodiments described herein relate generally to fluid dispensing systems and related methods, and more particularly to fluid dispensing systems that can dispense a fluid selected from one or more fluid sources in an environmentally friendly manner. Such systems and related methods may be particularly effective for use in dispensing automotive fluids, for example, motor oil, transmission oil, antifreeze, windshield fluid, etc.

Current methods for dispensing automotive fluids include dispensing from plastic containers and dispensing from bulk container systems. For example, in some instances, motor oil is supplied in, and dispensed from, one quart and/or one gallon plastic containers. Some automotive servicing facilities dispense automotive fluid(s) from one or more bulk container systems that store relatively large quantities of automotive fluids, for example, a 500 gallon bulk container system for storage and dispensing of motor oil. Such a bulk container system may be pressurized to facilitate dispensing of the stored fluid.

Current methods for dispensing automotive fluids, however, are not ideal. Many automotive fluids are considered hazardous fluids, so that avoiding spills becomes an important consideration. Unfortunately, the use of plastic containers typically results in an amount of fluid left within a container after the fluid is dispensed. Although this amount of fluid is small compared to the volume of the container, this small amount aggregates to a significant quantity of fluid when multiplied by the number of containers used. In many instances, the total amount of automotive fluid required may result in a significant amount left in a particular container, for example, one half quart left in a one quart container, which also presents a storage, use, and/or disposal challenge. Plastic containers also present a disposal challenge, which may involve recycling at best.

Bulk storage systems, while avoiding the use of multiple plastic containers, are also not ideal. Bulk storage systems can be expensive to install and maintain due, for example, to governing safety and environmental regulations. In many locations, commercial operators of bulk storage systems, such as automotive fluid change businesses, may be subject to significant fines if their bulk storage system(s) are not installed and maintained in accordance with governing regulations. A pressurized bulk storage system may be more susceptible to developing a leak, which may result in the spilling of a significant amount of fluid.

In addition to the above disadvantages, current methods for dispensing automotive fluids provide for less than ideal functionality. Accordingly, improved systems and related methods that provide for dispensing of a fluid in a controlled manner are desirable.

BRIEF SUMMARY

The present disclosure provides fluid dispensing systems, and related methods, which can be used to dispense a fluid selected from one or more fluid sources in an environmentally friendly manner. Such systems and related methods may be particularly effective for use in dispensing automotive fluids, for example, motor oil, transmission oil, antifreeze, windshield fluid, etc.

In one aspect, an automotive fluid dispensing system having a dispense mode and a non-dispense mode is provided. The dispensing system includes a supply line configured to couple with a container holding a quantity of an automotive fluid, a pump in fluid communication with the supply line, and a dispensing gun in fluid communication with the pump. The pump is driven when the dispensing system is in the dispense mode so that automotive fluid is transferred from the supply line to the dispensing gun. The pump is not driven when the dispensing system is in the non-dispense mode. The system can include a sensor to detect a user input used to initiate the dispense mode.

In another aspect, a system for dispensing an automotive fluid selected from a plurality of automotive fluids is provided. The system includes a plurality of supply lines, a pump assembly in fluid communication with the plurality of supply lines, and a dispensing gun in fluid communication with each of the plurality of pumps. Each supply line is configured to couple with a container holding a quantity of an automotive fluid. The pump assembly including a plurality of pumps corresponding to the plurality of supply lines. Each pump is in fluid communication with an associated supply line of the plurality of supply lines. The pump assembly transfers automotive fluid from a selected supply line to the dispensing gun in response to an operator input. The system can include a sensor to detect the operator input used to activate the pump assembly.

For a fuller understanding of the nature and advantages of the present invention, reference should be made to the ensuing detailed description and the accompanying drawings. Other aspects, objects and advantages of the invention will be apparent from the drawings and the detailed description that follows.

DETAILED DESCRIPTION

Figure 1:
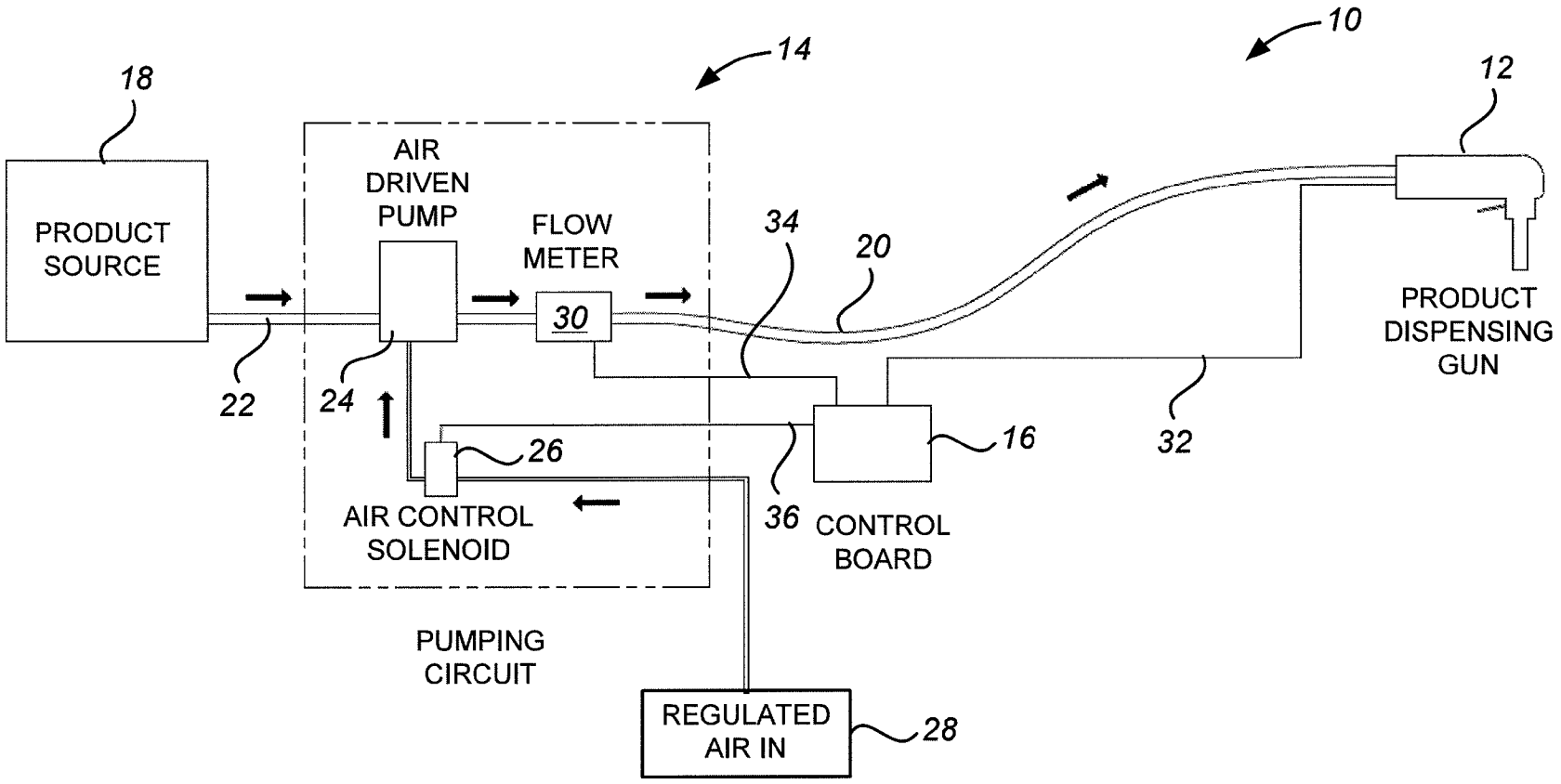
FIG. 1 is a simplified block diagram illustrating an environmental friendly fluid dispensing system, in accordance with many embodiments.

In accordance with various aspects and embodiments of the present disclosure, systems and related methods for dispensing a fluid are provided. These systems and methods can be used to dispense a fluid in a controlled manner, which may result in less environmental damage due to fewer spills and/or more complete evacuation of fluid from a fluid source. In many embodiments, these systems and methods can be used to dispense a fluid selected from one of multiple fluid storage containers. Such systems and methods may be particularly effective when used for dispensing automotive fluids, for example, motor oil, transmission fluid, antifreeze, windshield fluid, etc. When constructed of suitable materials, these systems and methods can also be used in food service applications.

In many embodiments, the disclosed systems and methods provide for the selection, metering, and dispensing of one of multiple brands and/or grades of fluid via a single dispensing device. In many embodiments, an integral means of closing the dispense point (e.g., nozzle) at the conclusion of the dispense operation is used to minimize the amount of fluid (hazardous material) that would otherwise continue to flow, albeit at a low rate (e.g., after-drip). The disclosed systems and methods can be used to dispense fluid from different containers, for example, from one or more bulk containers, and/or from one or more "bag-in-box" (BIB) bulk containers. A BIB container may be more environmentally friendly for a number of reasons, for example, for the ability to more completely extract fluid from the BIB container as compared to other container types, and where the BIB container is itself configured to be recyclable. The disclosed systems and methods can use a dispensing mode that include on-demand dispensing and/or portion-controlled dispensing. The disclosed systems and methods can use a user friendly display that, for example, provides for the selection of fluid brand and/or amount of fluid to be dispensed. The user friendly display can be located on the dispense device and/or located remotely.

In many embodiments, the disclosed systems and methods provide a number of features and/or capabilities. For example, a dispensing device can be configured for use with multiple fluid inputs. In many embodiments, a dispensing device can be used to directly select a fluid to be dispensed from a number of fluids. Additionally, the fluid selection can also be accomplished remotely from a dispensing device. The selected fluid can be indicated on a user friendly display, which in many embodiments is located on a dispensing device. During dispensing of the selected fluid, the volume dispensed can be displayed. A volume can be specified for the selected fluid and, following initiation of the dispense action, the specified amount (portion) can be automatically dispensed. In many embodiments, a dispensing device is configured to reduce co-mingling (carry-over) between different selected fluids below an acceptable level by configuring the dispensing device accordingly. In many embodiments, a nozzle-closure device is used to seal the dispense point (nozzle) at the termination of a dispense action.

FIG. 1 illustrates an environmental friendly product dispensing system 10, in accordance with many embodiments. The dispensing system 10 includes a product dispensing gun 12, a pump assembly 14, a control board 16, and a product source 18. The dispensing gun 12 is coupled with the pump assembly 14 by way of a supply line 20, which can include one or more lumens for providing one or more selected fluids to the dispensing gun 12. As will be discussed in more detail below, the dispensing gun 12 can include control features that allow for the selection and controlled dispensing of a fluid from the product source 18.

The pump assembly 14 provides for controlled transfer of a selected fluid from the product source 18 to the dispensing gun 12. The pump assembly 14 is coupled with the product source 18 by way of a supply line 22, which can include one or more lumens for transferring one or more selected fluids from the product source 18 to the pump assembly 14. The pump assembly 14 includes at least one pump, for example an air driven pump 24, for transferring a fluid from the product source 18 to the dispensing gun 12. In many embodiments, the pump assembly 14 includes two or more pumps that can be selectively engaged to transfer a selected fluid from the product source 18 to the dispensing gun 12. The one or more pumps of the pump assembly 14 can be controlled by one or more control solenoids, for example an air control solenoid 26. Where at least one air driven pump 24 is used, a source of regulated pressurized air 28 can be used to drive the at least one air driven pump. In many embodiments, one or more flow meters 30 are used to measure one or more fluid flows transferred from the product source 18 to the dispensing gun 12.

In many embodiments, the control board 16 is used to control the operation of the pump assembly 14 in response to signals received from the product dispensing gun 12. The control board 16 can be coupled to the dispensing gun via an electrical cable 32, for example, an electrical cable that includes power leads (e.g., 5V and ground leads) and one or more control leads (e.g., an RS 485 control cable). The control board can be coupled with the one or more flow meters and the one or more control solenoids via electrical cables 34, 36, respectively, so that the one or more control solenoids can be actuated to drive one or more fluid pumps in order to transfer a controlled quantity of fluid from the product source to the dispensing gun. One or more processors and one or more memories can be used to provide functional control of the dispensing system. These one or more processors and one or more memories can be located in a variety of locations, for example, in the control board, the dispensing gun, and/or other suitable locations.

As will be discussed in more detail below, in many embodiments, an operator uses a control panel (not shown in FIG. 1) integrated with the product dispensing gun 12 to select a fluid to be dispensed and can select a quantity of the selected fluid to be dispensed. The dispensing gun control panel can also provide the operator with additional functionality, for example, display of the name of the product dispensed, display of the amount dispensed, editing of product information, tracking of cumulative amounts of product dispensed, amount of product remaining, etc.

Figure 2:
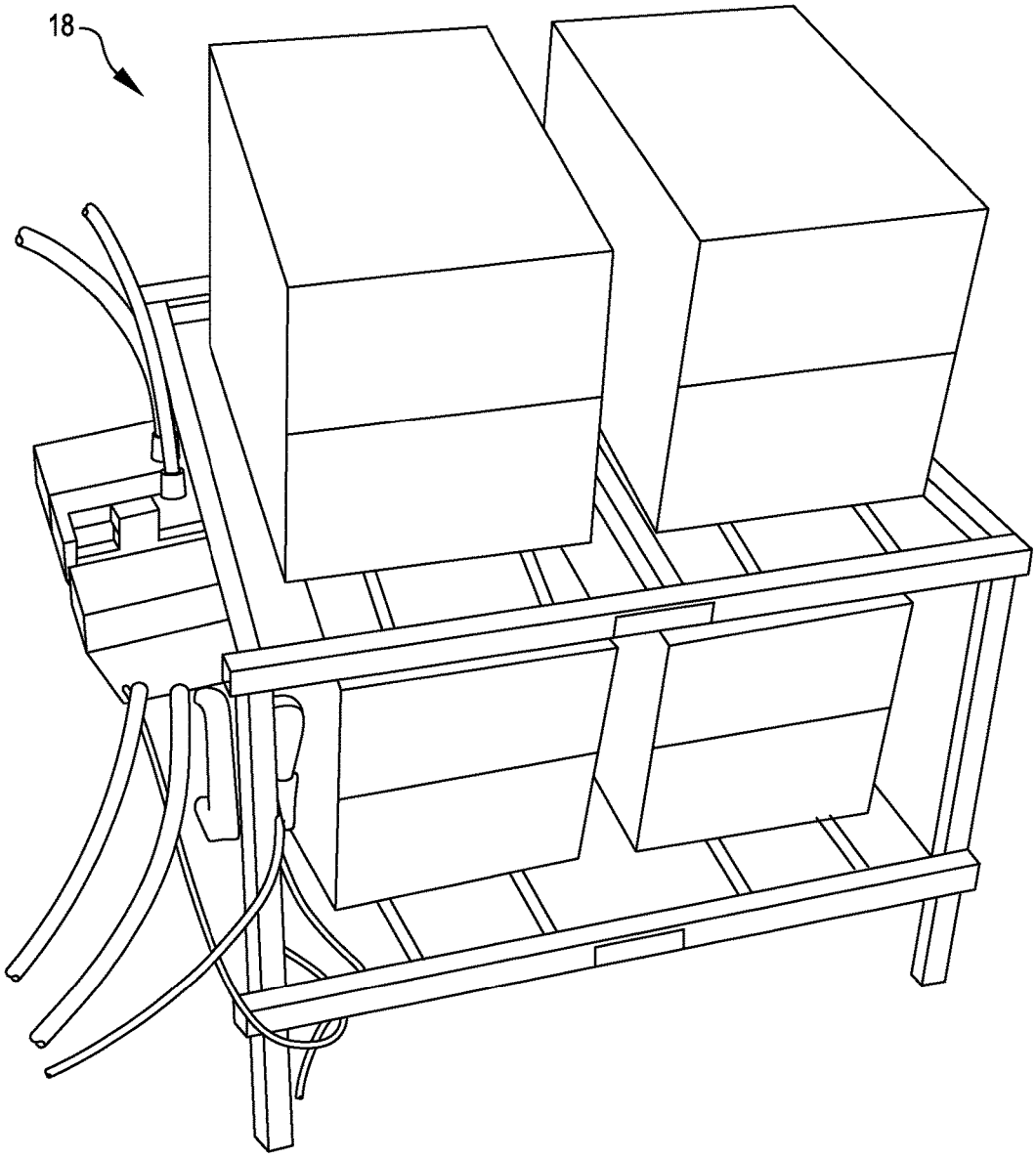
FIG. 2 illustrates a product source with four fluid containers, in accordance with many embodiments.

FIG. 2 illustrates an example product source 18, in accordance with many embodiments. The example product source 18 shown includes four separate motor oil box containers, each of which has a collapsible bladder that contains a motor oil having the indicated weight. Each of these separate motor oil box containers can be coupled with the pump assembly 14 via a separate supply line so that the pump assembly can selectively draw fluid from a selected box. The use of a container having a collapsible bladder may provide the ability to more fully evacuate the contents of the container on account of the ability to more fully draw the fluid out of the box via the action of the pump assembly. In FIG. 2, two of the containers are for a first product weight (SAE 5W-30) and two of the containers are for a second product weight (SAE 10W-30); as can be appreciated, this arrangement can be used to provide for continued use of the dispensing system while an empty product container is replaced.

Figure 3:
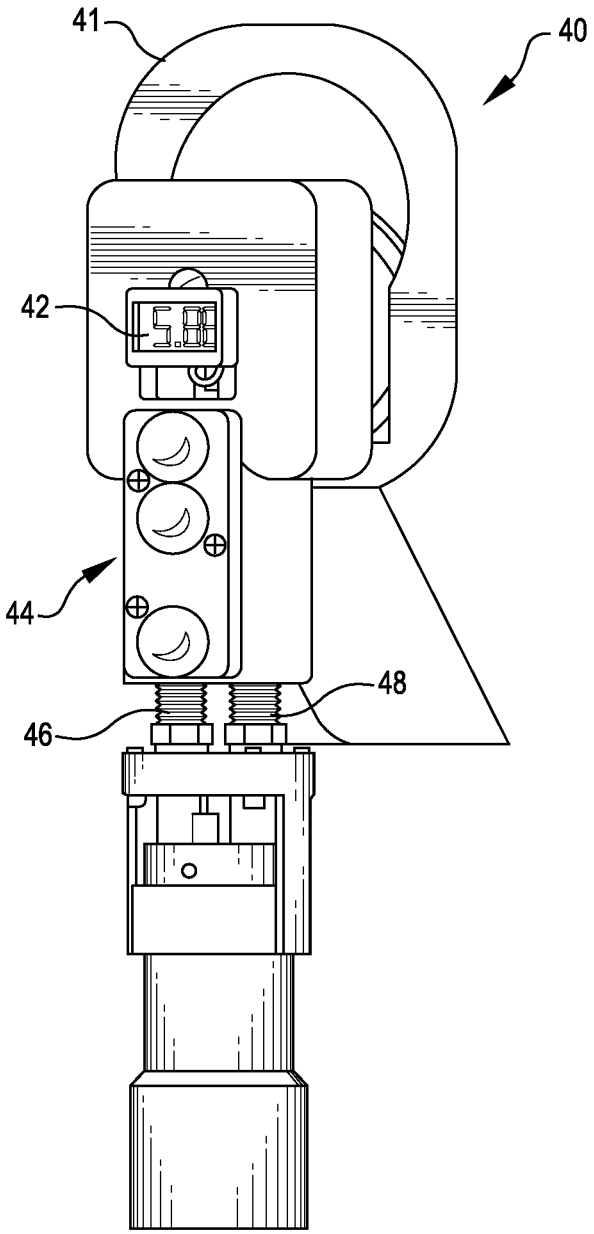
FIG. 3 is a perspective view of a product dispensing gun, in accordance with many embodiments.
Figure 4:
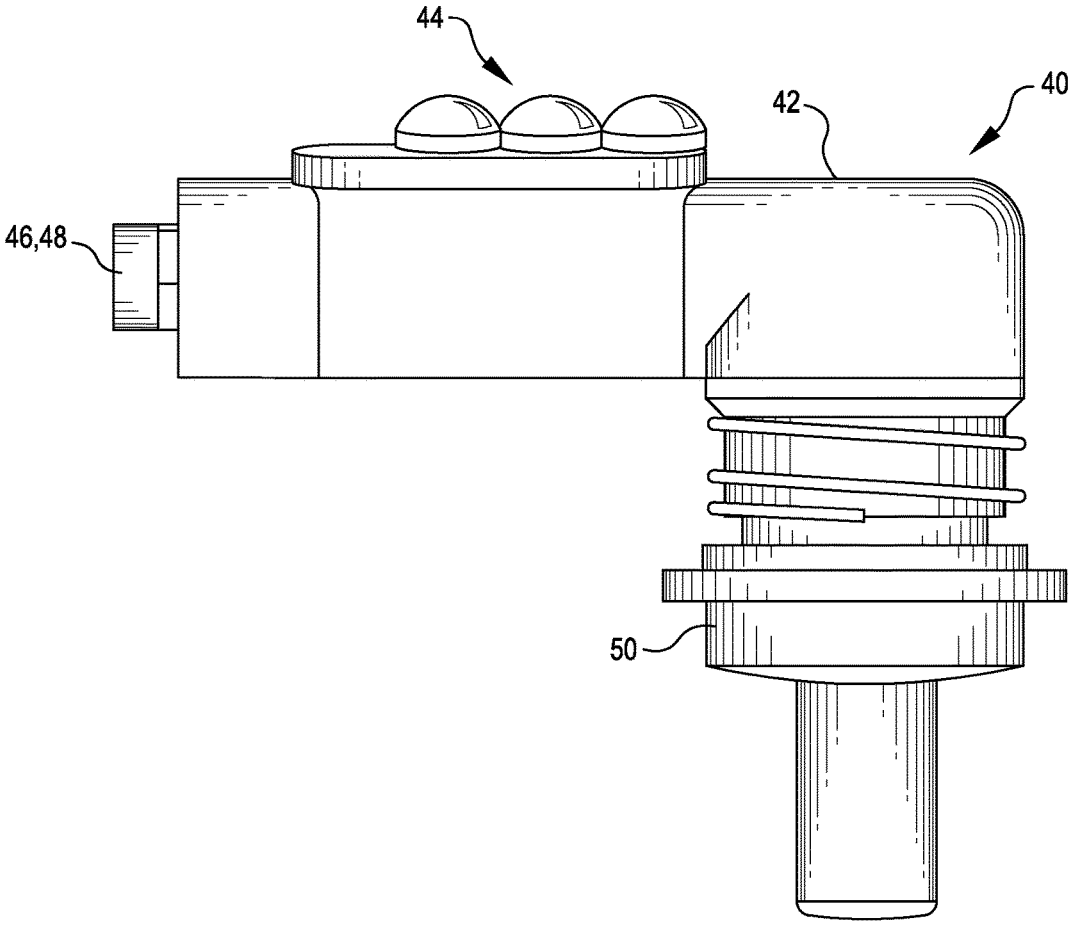
FIG. 4 is a side view of a product dispensing gun, in accordance with many embodiments.
Figure 5B:
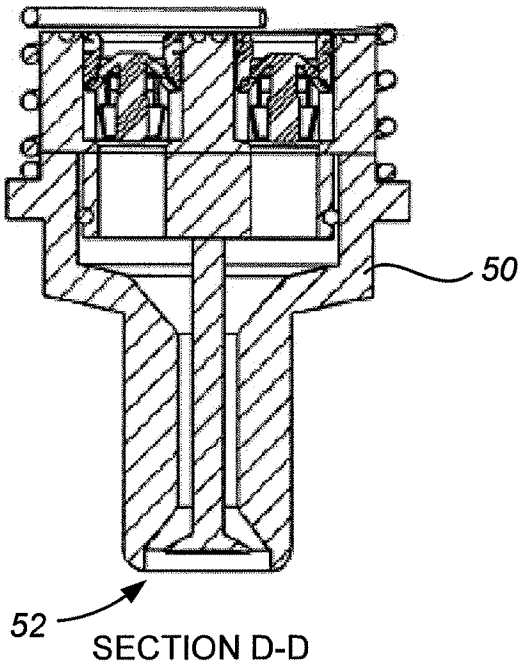
FIGS. 5A and 5B illustrate a product dispensing gun nozzle, in accordance with many embodiments.
Figure 5A:
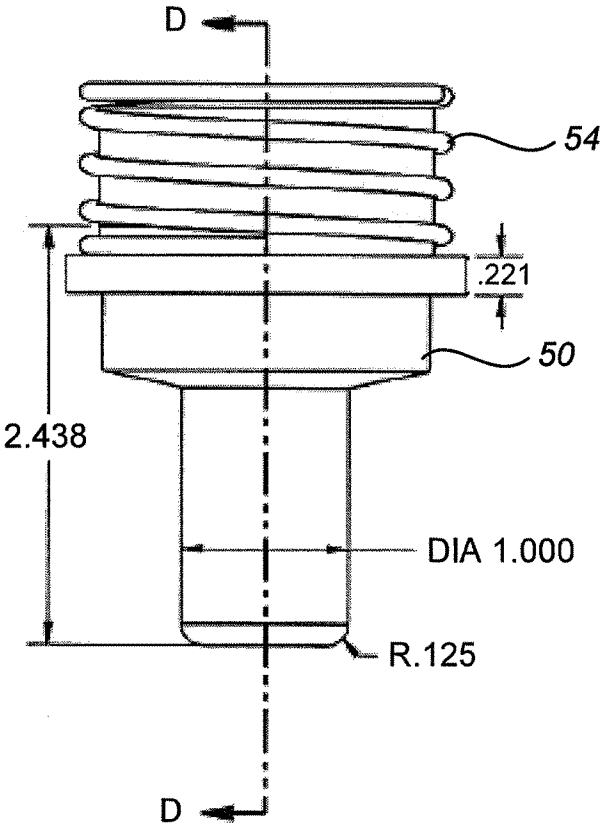

FIG. 3 is a perspective view of a product dispensing gun 40 in a holster 41, in accordance with many embodiments. The product dispensing gun 40 includes a display 42 and control buttons 44. The product dispensing gun 40 shown is configured to selectively dispense one of two fluids that are supplied to the dispensing gun 40 via one of a first supply conduit 46 or a second supply conduit 48. FIG. 4 is a side view of the product dispensing gun 40, showing a spring-loaded dispensing nozzle 50 that includes a check valve for preventing the discharge of fluid from the dispensing nozzle 50 when the dispensing nozzle is not depressed. FIGS. 5A and 5B illustrate the open configuration of the check valve 52, which is produced by compressing the nozzle against the force of a spring 54. Although not illustrated, in many embodiments, compression of the nozzle can be used to generate an electrical signal that is used to enable the pumping of a selected fluid from the product source to the dispensing gun. Likewise, the absence of compression of the nozzle can be used to disable any pumping of fluid from the product source to the dispensing gun, which can be used to provide for an unpressurized system when no fluid is being dispensed. As can be appreciated, having the system unpressurized when no fluid is being dispensed may provide for decreased exposure to spills, for example, due to reduced exposure to pressure induced failures in a supply line or other pressurized component.

Figure 6A:
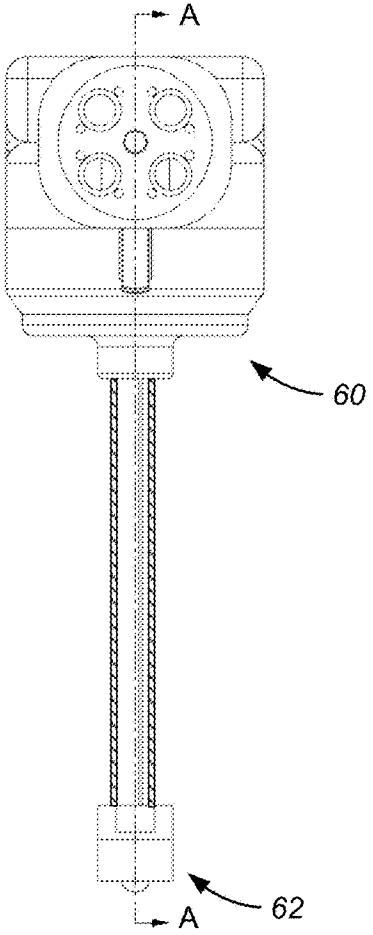
FIGS. 6A, 6B, and 6C illustrated details of an integrated nozzle check valve of a product dispensing gun, in accordance with many embodiments.
Figure 6B:
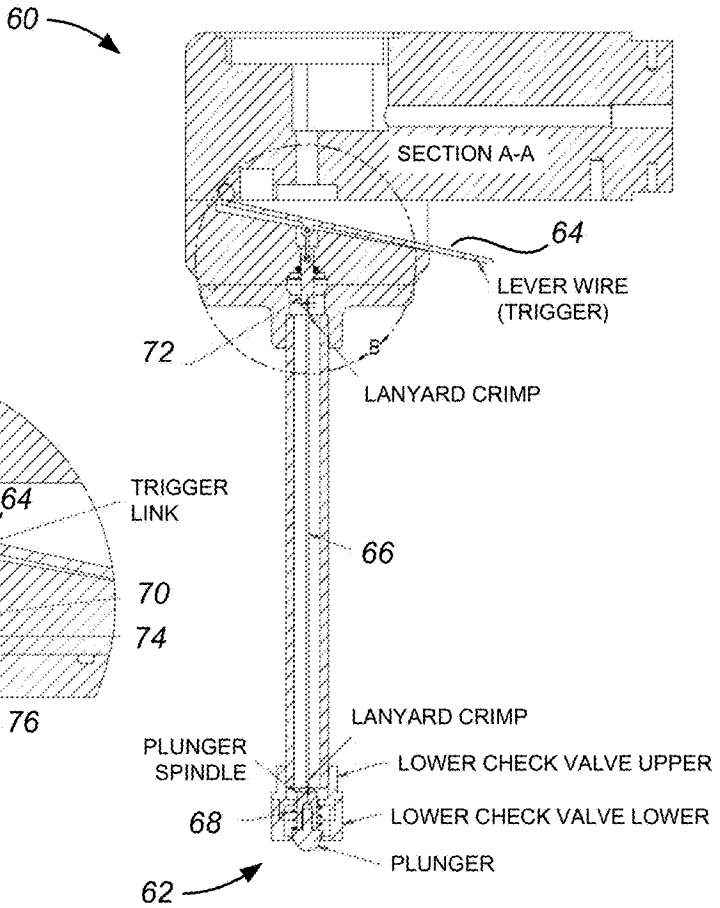
Figure 6C:
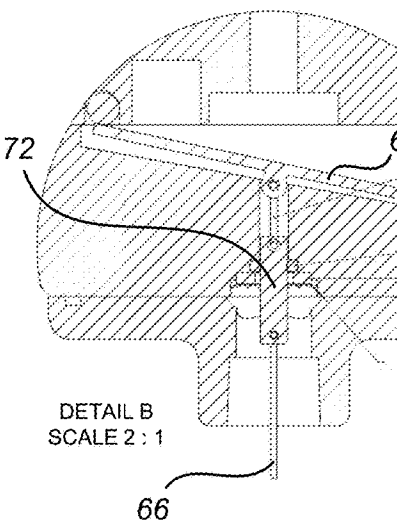

FIGS. 6A, 6B, and 6C illustrated details of an integrated nozzle check valve of a product dispensing gun 60, in accordance with many embodiments. The check valve 62 is located at the output of the dispensing gun 60. The check valve 62 is coupled with a trigger assembly 64 via a lanyard 66. Upon actuation of the trigger assembly 64, the motion of the lanyard 66 pulls the check valve 62 into the open configuration against the force of a return spring 68. Upon release of the trigger assembly 64, the return spring 68 closes the check valve 62. FIG. 6C illustrates the details of the coupling between the lanyard 66 and the trigger assembly 64, which include an o-ring seal 70 that seals between the handle and a trigger spindle 72, thereby preventing fluid from escaping in the vicinity of the trigger assembly through the passage way used for the provisions coupling the lanyard with the trigger assembly. The o-ring seal 70 is retained with the use of a flat washer 74 and a retaining ring 76.

Figure 7:
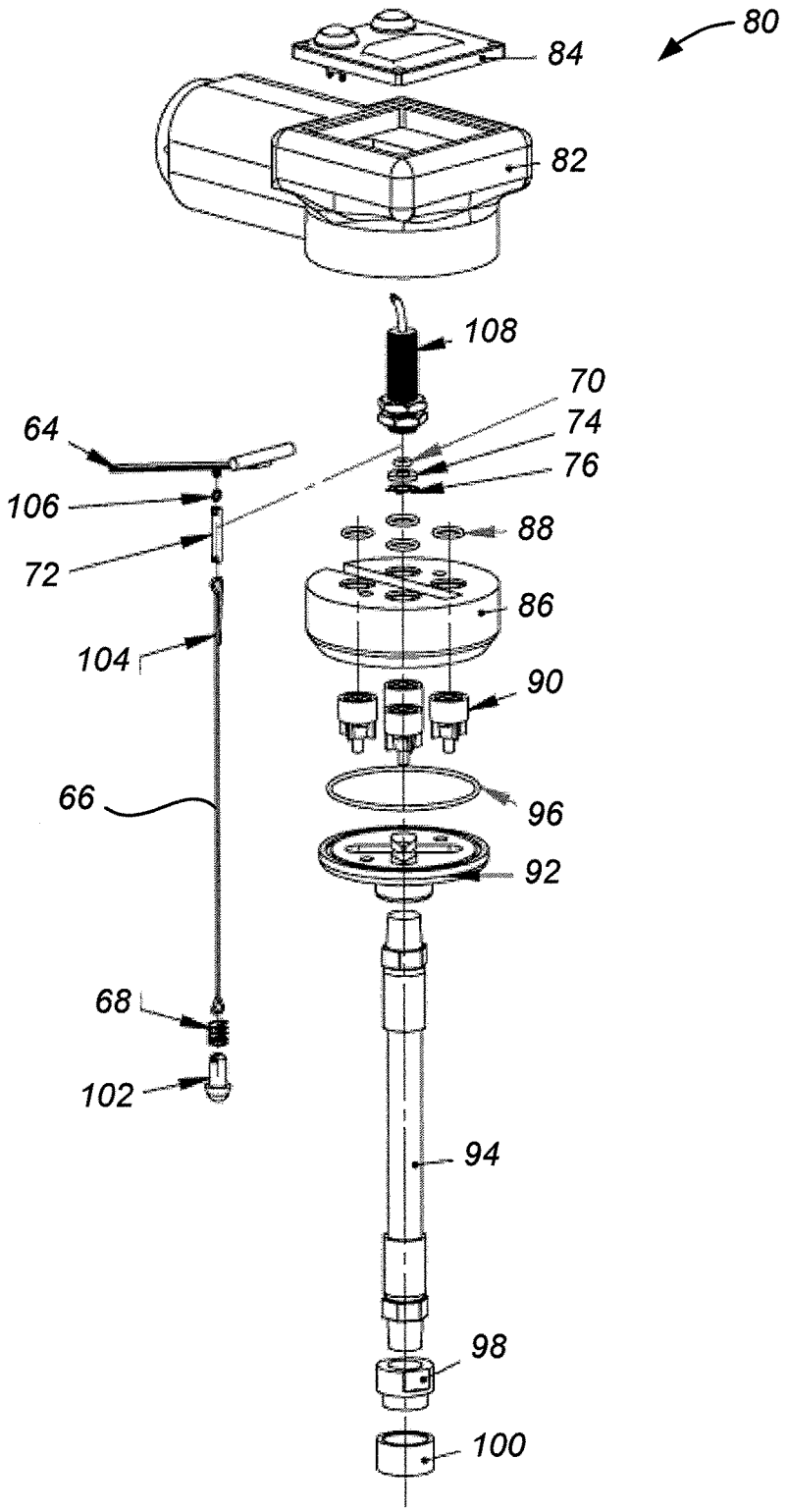
FIG. 7 is an exploded perspective view of a four-product dispensing gun assembly, in accordance with many embodiments.

FIG. 7 provides an exploded-view illustration of a four-product dispensing gun assembly 80, in accordance with many embodiments. The dispensing gun 80 includes a handle component 82, into which a control panel 84 is mounted. Four separate fluid lines (not shown) are coupled with the handle component 82, which places the four fluid lines in fluid communication with a check-valve manifold 86. Four o-rings 88 provide for sealing between four ports of the check-valve manifold 86 and a corresponding four ports in the handle component 82. The check-valve manifold 86 places the four fluid lines in fluid communication with four check valves 90. Each check valve 90 is configured to be closed in the absence of a supply of pressurized fluid and to open in response to fluid pressure. The combination of the check valves and selective pressurization of a fluid supply line is used to control which fluid is dispensed from the dispensing gun. The check-valve manifold 86 is coupled with a combining manifold 92, which places the output of each of the check valves in fluid communication with a transport tube 94. An o-ring 96 is used to seal between the check-valve manifold 86 and the combining manifold 92. Lower check valve components 98, 100 are disposed at the end of the transport tube 94.

As discussed above with reference to FIGS. 6A, 6B, and 6C, a trigger actuated lower check valve can be used to block the escape of fluid when the trigger is not depressed. The trigger assembly 64, lanyard 66, trigger spindle 72, and other lower check valve related components (e.g., a lower check valve plunger 102, the return spring 68, a lanyard crimp 104, a trigger link 106) are shown offset from the centerline of the above discussed assembly, but in reality are disposed similar to as illustrated in FIGS. 6A, 6B, and 6C.

The product dispensing gun 80 further includes a sensor 108 (e.g., a proximity sensor, an contact switch, etc.) that is used to sense when the trigger has been depressed. The sensor 108 is used to provide a signal that can be used to enable the actuation of the pump assembly so that a selected fluid is supplied to the product dispensing gun 80 only when the trigger has been depressed. When the trigger is released, the signal from the sensor 108 can be used to disable the supply of the selected fluid to the dispensing gun 80. As discussed above, this selective pressurization may reduce the occurrence and/or amount of fluid that is inadvertently leaked or spilled from the dispensing system.

Figure 8:
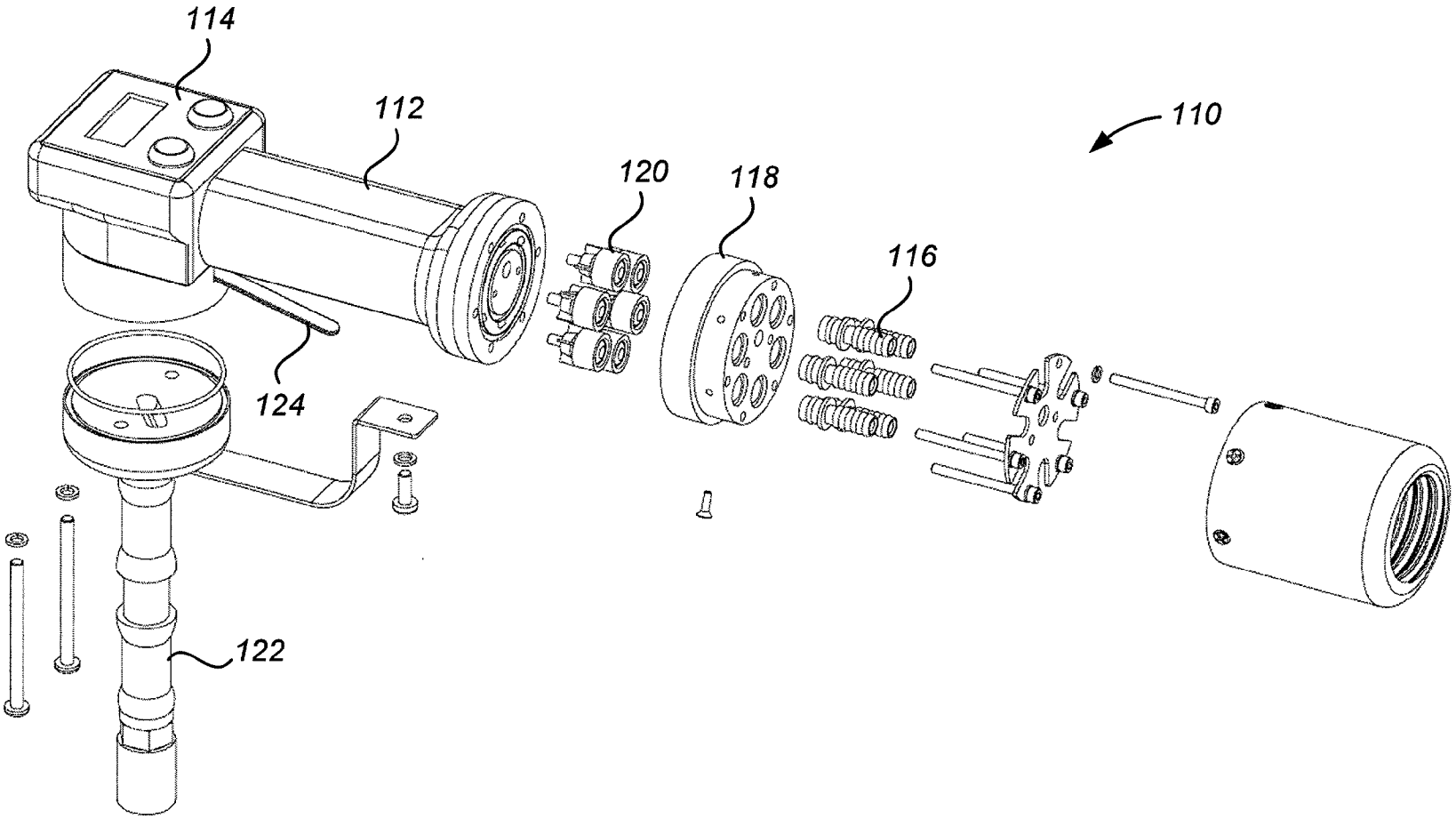
FIG. 8 is an exploded perspective view of a six-product dispensing gun assembly, in accordance with many embodiments.

FIG. 8 provides an exploded-view illustration of a six-product dispensing gun assembly 110, in accordance with many embodiments. The dispensing gun assembly 110 includes a handle component 112, into which a control panel 114 is mounted. Each of six fluid lines (not shown) are coupled with one of six inlet couplings 116. The six inlet couplings 116 place the six fluid lines in fluid communication with six ports of a check-valve manifold 118. Six check valves 120 couple with the check-valve manifold 118. The check valves 120 function similar to the check valves 90 as discussed above with reference to FIG. 7. Fluid discharged from any of the check valves 120 enters an annular cavity within the handle component 112. The annular cavity is in fluid communication with the dispensing nozzle 122. In many embodiments, the dispensing nozzle 122 includes a lower check valve assembly that is coupled with a trigger assembly 124 so that fluid is prevented from being dispensed from the dispensing gun assembly 110 unless the trigger assembly 124 is depressed. For example, such a trigger coupled check valve assembly can be configured similar to the trigger coupled check valve assembly discussed above with reference to FIGS. 6A, 6B, 6C, and 7.

Figure 9A:
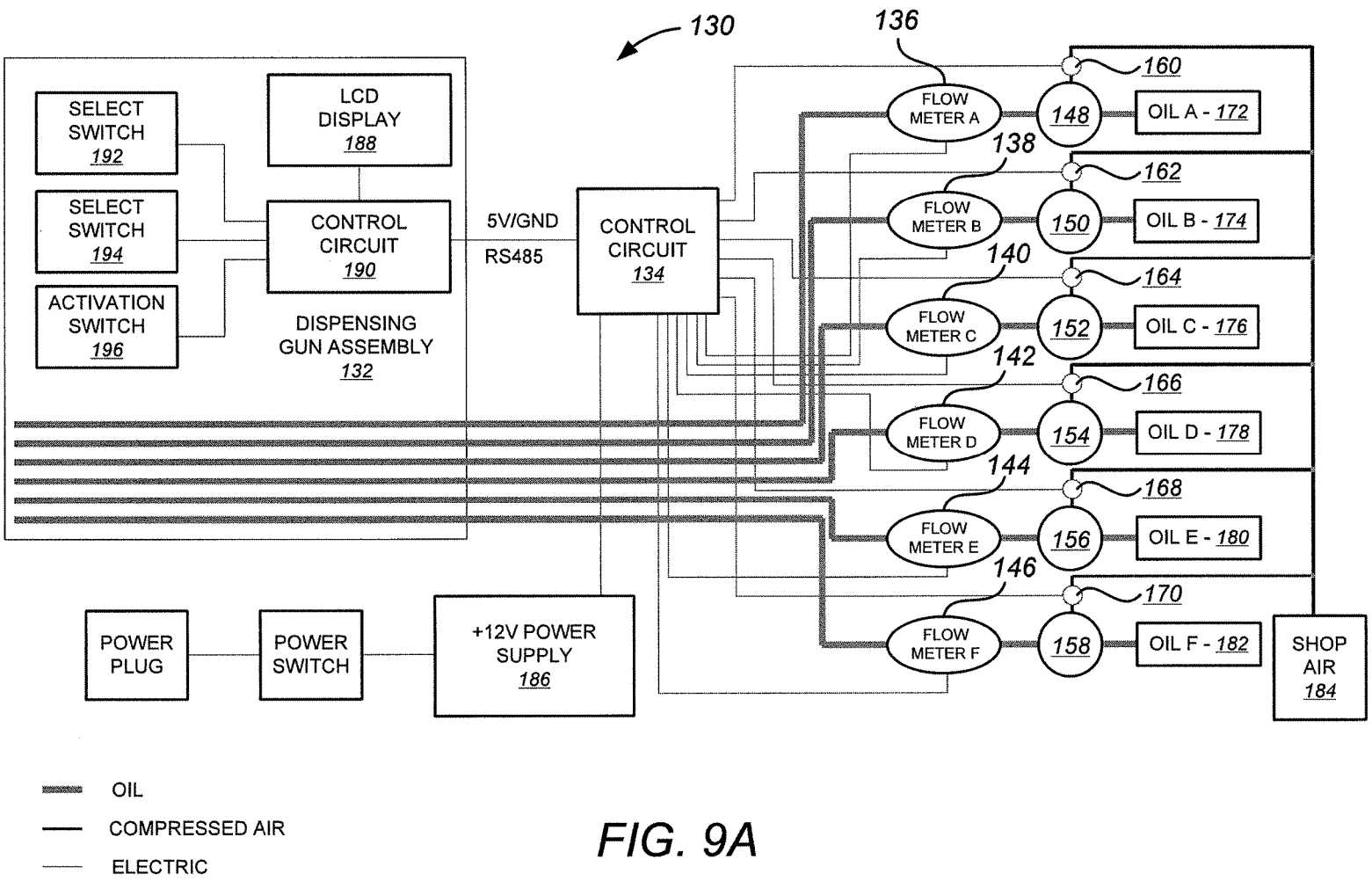
FIG. 9A is a simplified block diagram illustrating a six-product dispensing system, in accordance with many embodiments.
Figure 9B:
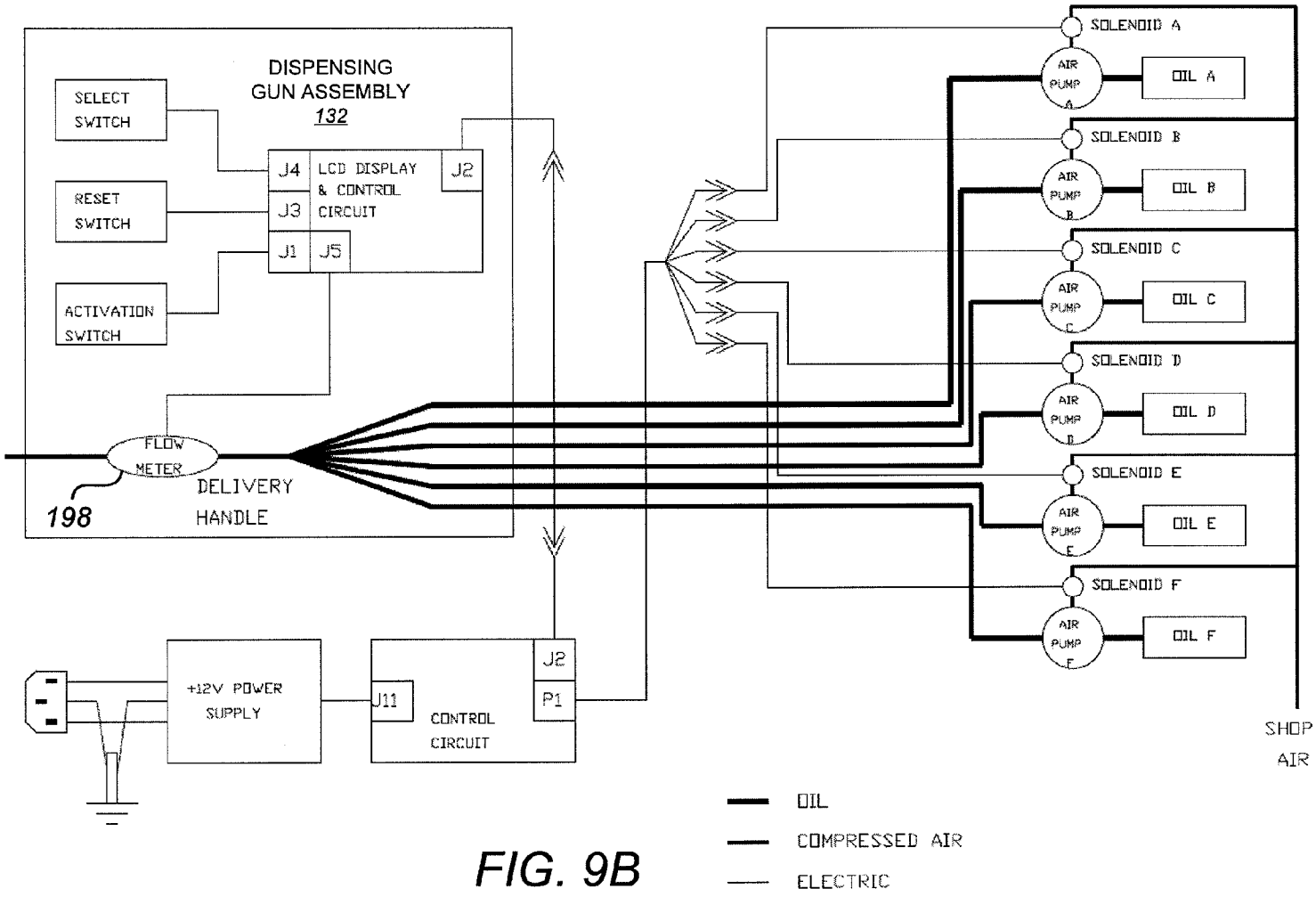
FIG. 9B is a simplified block diagram illustrating a six-product dispensing system having a single dispensing gun located flow meter, in accordance with many embodiments.

FIG. 9A provides a simplified block diagram illustrating a six-product dispensing system 130, in accordance with many embodiments. The dispensing system 130 includes a dispensing gun assembly 132; a control circuit 134; flow meters 136, 138, 140, 142, 144, 146; air pumps 148, 150, 152, 154, 156, 158; air flow control solenoids 160, 162, 164, 166, 168, 170; fluid sources 172, 174, 176, 178, 180, 182; a source of regulated shop air 184; and a power supply 186. The dispensing gun assembly includes a LCD display 188; a control circuit 190; select switches 192, 194; and activation switch 196. In certain applications, it may be beneficial to replace the separate flow meters 136, 138, 140, 142, 144, 146 with a single flow meter 198 located in the dispensing gun assembly 132 as illustrated in FIG. 9B, through which each selected product is measured/monitored.

In operation, the dispensing system 130 can be used to dispense a selected fluid in a controlled fashion. For example, an operator can interact with the dispensing system 130 via the select switches 192, 194; the activation switch 196; and the LCD display 188 to select the fluid to be dispensed, as well as the quantity of the fluid to be dispensed. For example, an operator can select to dispense 5.5 quarts of oil C from fluid source 176. Upon depressing a dispensing trigger, the dispensing system can dispense the selected fluid by energizing control solenoid 164, thereby providing air pump 152 with drive air from the source of regulated shop air 184. The flow meter 140 measures the amount of fluid provided to the dispensing gun assembly 132 and the dispensing system 130 can de-energize the control solenoid 164 when the designated 5.5 quarts has been supplied, thereby ceasing the flow of drive air to the air pump 152, which ceases the flow of oil to the dispensing gun assembly. As another example, the operator can dispense fluid using an "on-demand" mode, in which fluid is dispensed as along as the activation switch 196 is depressed. The system can display the current amount of fluid dispensed to the operator so that the operator can control the total amount dispensed.

Control Functionality Flow Charts

FIGS. 10, 11, 12, 13, 14, and 15 provide flow charts illustrating an implementation of dispensing system functionality, in accordance with many embodiments. It should be appreciated that many other implementations are possible.

Figure 10:
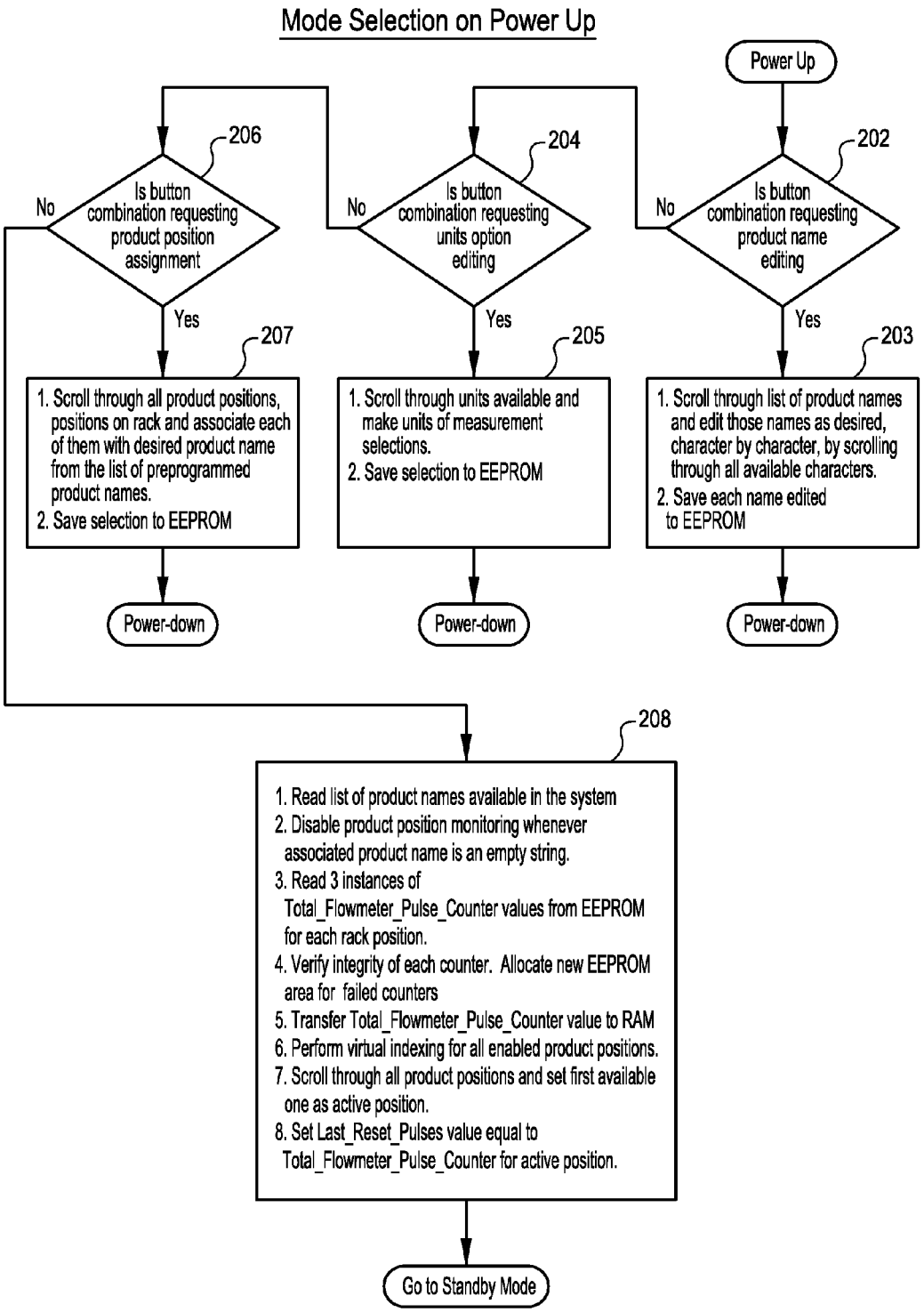
FIG. 10 is a flow chart illustrating an implementation of mode selection functionality for an environmental friendly product dispensing system, in accordance with many embodiments.
Figure 11:
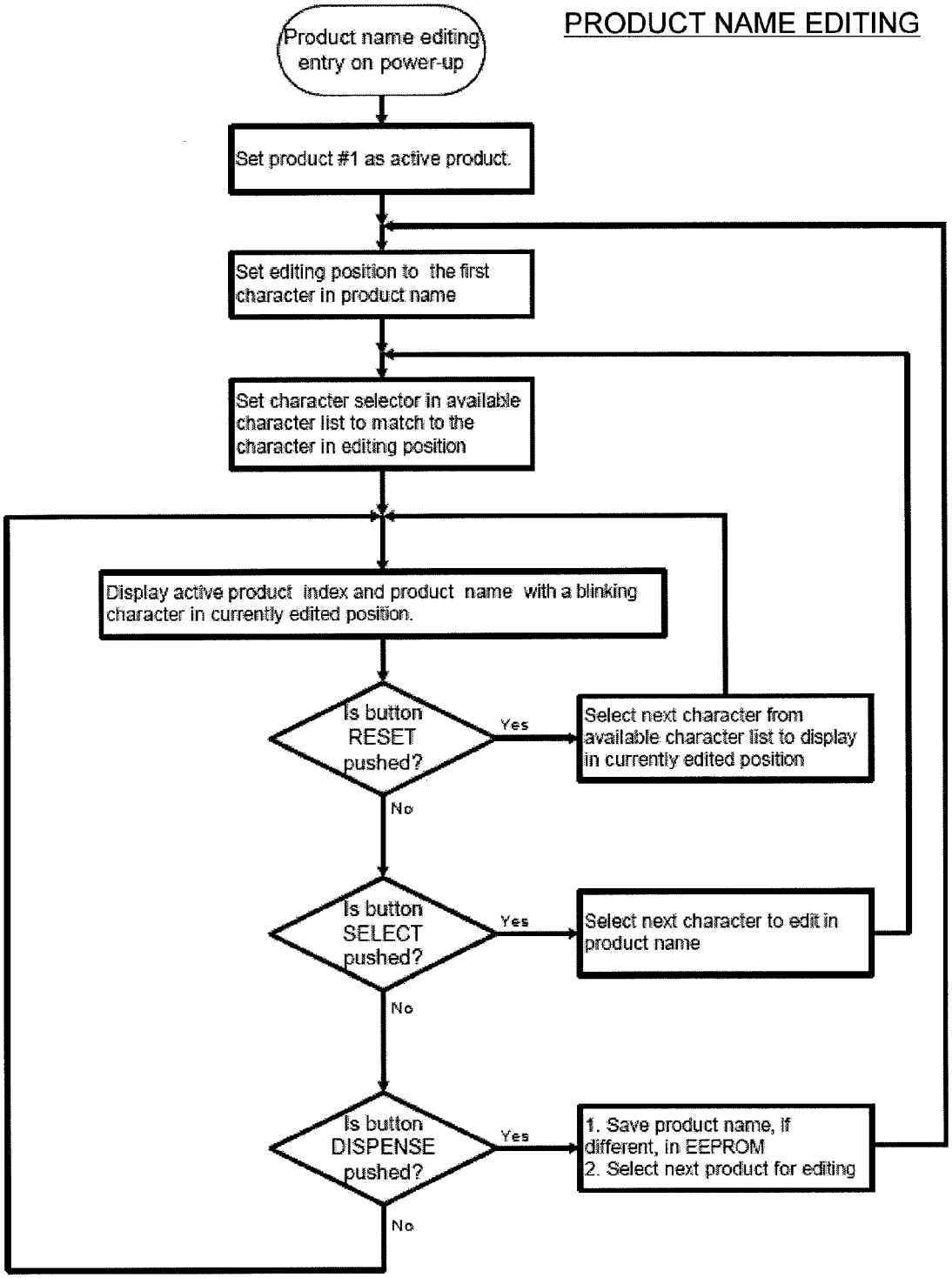
FIG. 11 is a flow chart illustrating an implementation of product name editing functionality for an environmental friendly product dispensing system, in accordance with many embodiments.

FIG. 10 illustrates an implementation of mode selection functionality for an environmental friendly product dispensing system, in accordance with many embodiments. In the implementation illustrated, certain input button combinations can be used upon power-up of the system to select a desired input mode for the system. For example, in block 202, the system, upon power-up, determines whether the selected button combination corresponds to a button combination for requesting product name editing; if the answer is yes, in block 203, the system provides the operator with the ability to edit any name from the listed product names (shown in more detail in FIG. 11). If the answer is no, in block 204, the system determines whether the selected button combination corresponds to a button combination for requesting units option editing; if the answer is yes, in block 205, the system provides the operator with the ability to make units of measurement selections. If the answer in no, in block 206, the system determines whether the selected button combination corresponds to a button combination for requesting product position assignment; if the answer is yes, in block 207, the system provides the operator with the ability to assign product index and product name to each product position (shown in more detail in FIG. 15). If no recognized button combination is depressed upon power-up, the system can proceed with the start-up configuration tasks listed in block 208 prior to entering standby mode.

Figure 12:
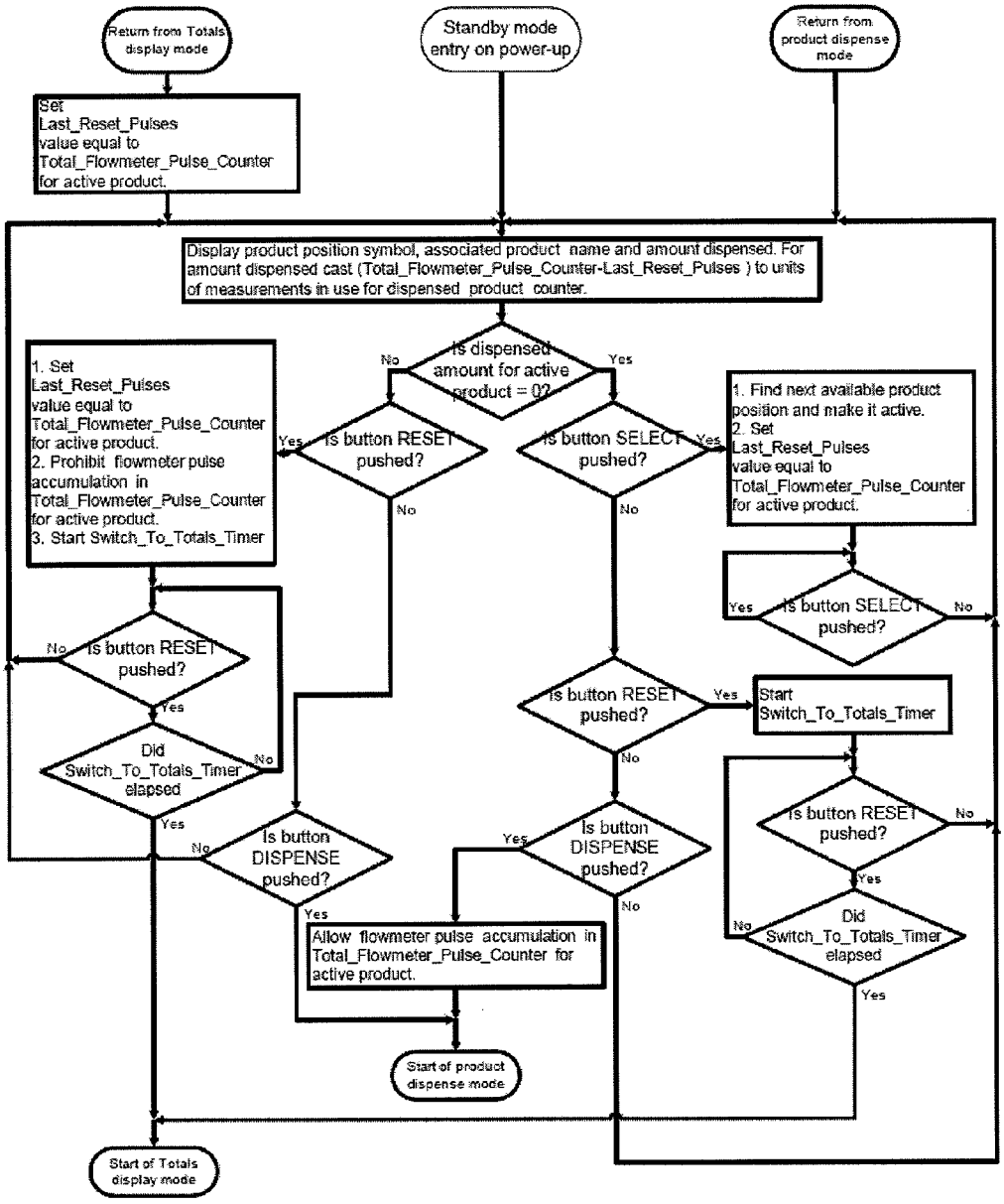
FIG. 12 is a flow chart illustrating an implementation of standby mode functionality for an environmental friendly product dispensing system, in accordance with many embodiments.
Figure 13:
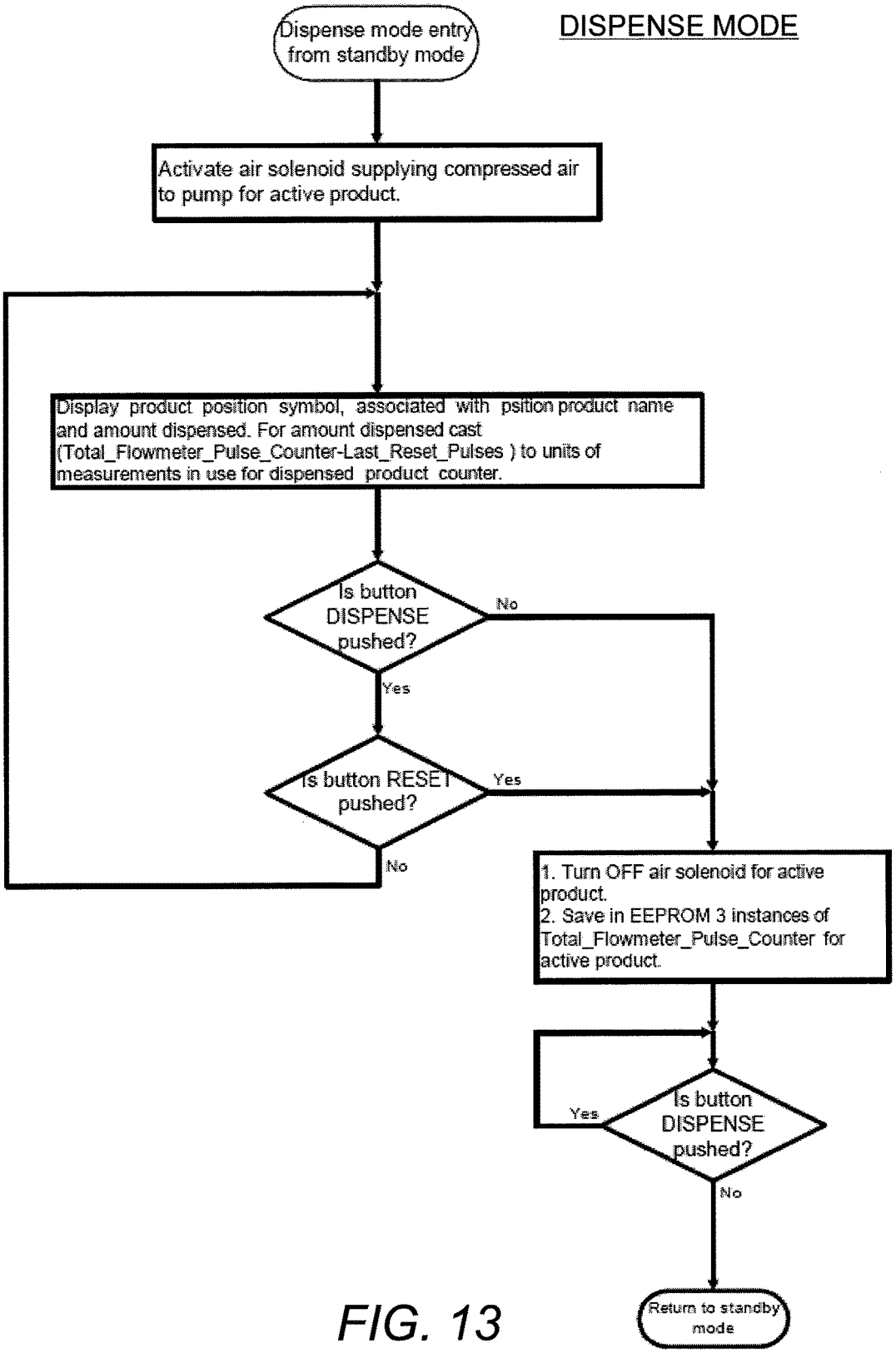
FIG. 13 is a flow chart illustrating an implementation of dispense mode functionality for an environmental friendly multiple product dispensing system, in accordance with many embodiments.
Figure 14:
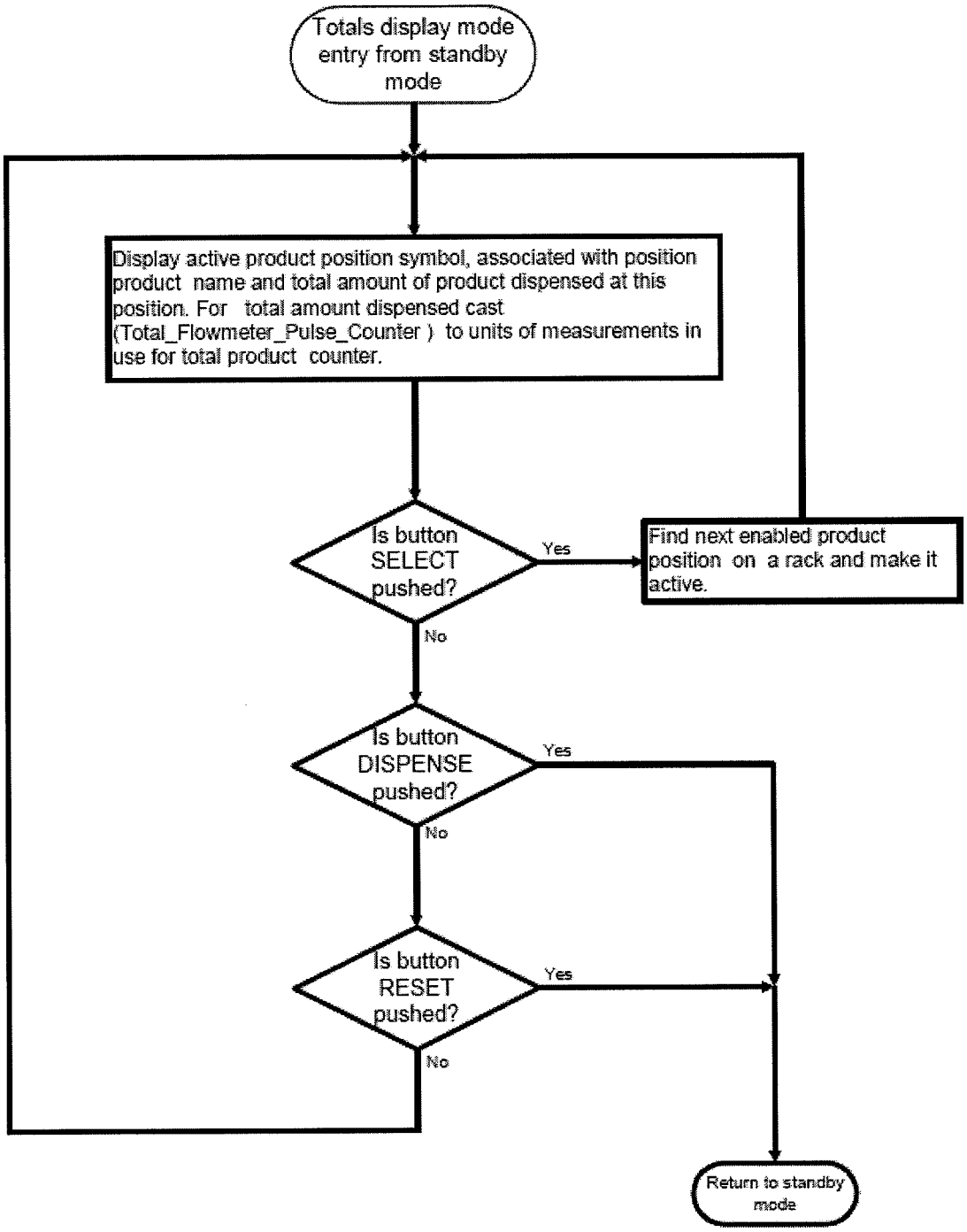
FIG. 14 is a flow chart illustrating an implementation of totals display mode functionality for an environmental friendly multiple product dispensing system, in accordance with many embodiments.

FIG. 12 provides a flow chart illustrating an implementation of system functionality that is accessible from the standby mode. As illustrated, from standby mode the system can enter into product dispense mode (shown in more detail in FIG. 13) or totals display mode (shown in more detail in FIG. 14). Once in dispense mode, the system can return to standby mode in response to release of the dispense button. Similarly, once in totals display mode, the system can return to standby mode upon pushing either the dispense button or the reset button.

Figure 15:
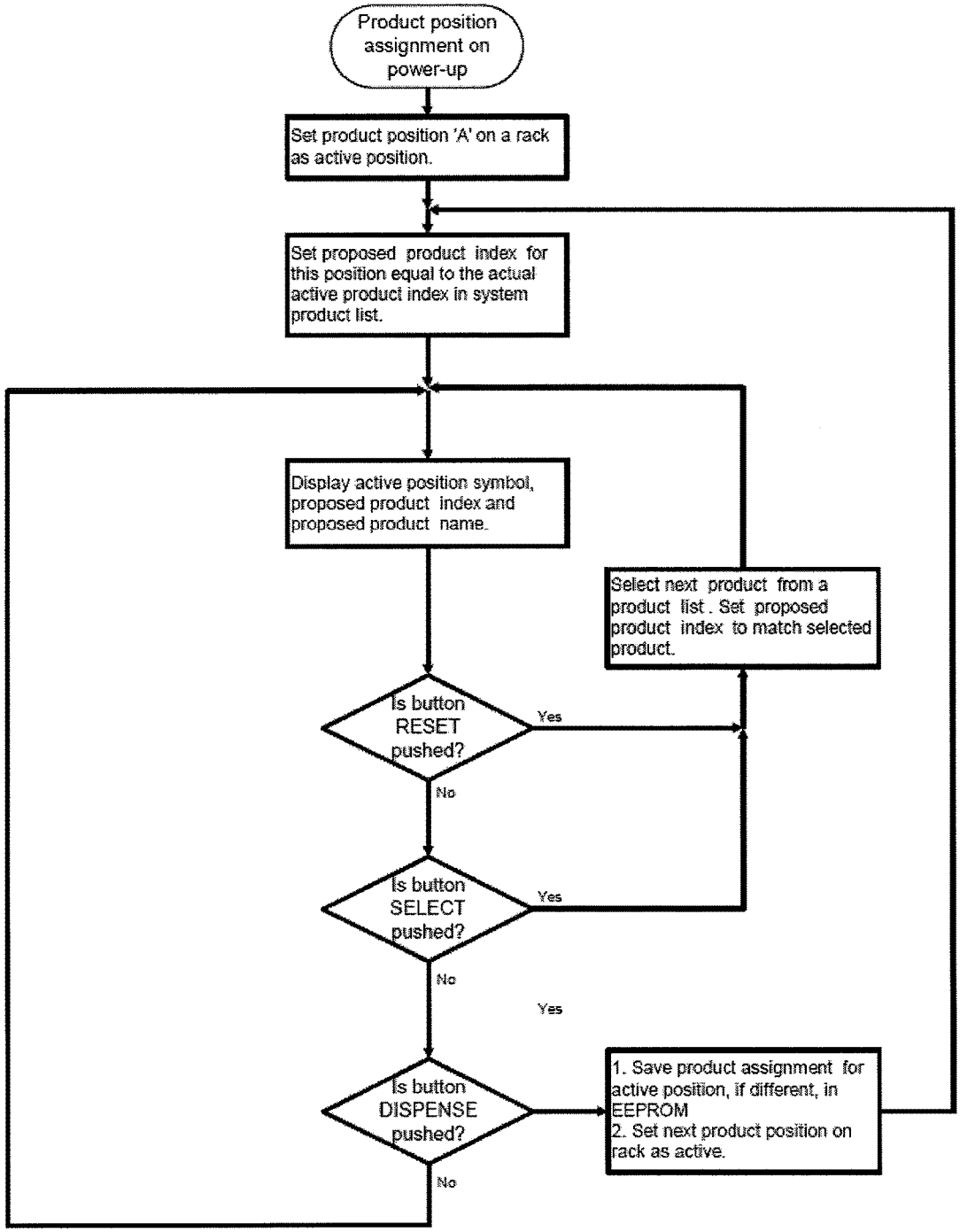
FIG. 15 is a flow chart illustrating an implementation of product position assignment mode functionality for an environmentally friendly multiple product dispensing system, in accordance with many embodiments.

FIG. 15 provides a flow chart illustrating an implementation of product position assignment mode. In this mode the operator maps product into each position on the rack. If the product name assigned to any rack position is an empty string, the system can disable and ignore this position in the standby and totals display modes.

It is understood that the examples and embodiments described herein are for illustrative purposes and that various modifications or changes in light thereof will be suggested to a person skilled in the art and are to be included within the spirit and purview of this application and the scope of the appended claims. Numerous different combinations are possible, and such combinations are considered to be part of the present invention.

What is claimed is:

1. A system for dispensing an automotive fluid selected from a plurality of automotive fluids, the system comprising:

a plurality of supply lines, each supply line configured to couple with a respective container holding a quantity of an automotive fluid;

a pump assembly in fluid communication with the plurality of supply lines, the pump assembly including a plurality of pumps corresponding to the plurality of supply lines, each pump being in fluid communication with an associated supply line of the plurality of supply lines; and a dispensing gun in fluid communication with each of the plurality of pumps, wherein the pump assembly transfers the automotive fluid from a selected supply line to the dispensing gun in response to an operator input to activate the pump assembly, wherein the dispensing gun comprises a plurality of check valves, an outlet, a manifold in fluid communication with and between the plurality of check valves and the outlet, and a lower check valve provided at the outlet opposite from the plurality of check valves, wherein the plurality of check valves and the lower check valve substantially prevent the automotive fluid from being dispensed from the dispensing gun when the pump assembly is not transferring the automotive fluid to the dispensing gun, wherein the lower check valve is coupled externally to a dispensing end of the outlet to prevent the automotive fluid from being dispensed from the dispensing gun;

a trigger assembly coupled to the dispensing gun for controlling the transfer of the automotive fluid from the selected supply line to the dispensing gun outlet, wherein the lower check valve is coupled to the trigger assembly such that the lower check valve blocks an escape of the automotive fluid when the trigger assembly is not depressed;

wherein the lower check valve is coupled with the trigger assembly via a lanyard such that upon actuation of the trigger assembly, the lanyard pulls the check valve in an open configuration.

2. The system of claim 1, wherein the operator input to activate the pump assembly opens one of the plurality of check valves to dispense the automotive fluid from the outlet of the dispensing gun.

3. The system of claim 1, further comprising a flow meter to measure an amount of the automotive fluid transferred to the dispensing gun.

4. The system of claim 1, further comprising a plurality of flow meters corresponding to the plurality of pumps, each flow meter measuring an amount of the automotive fluid transferred to the dispensing gun by an associated pump.

5. The system of claim 1, wherein the operator input includes a first operator input and a second operator input, the system further comprising:

a control panel to accept the first operator input selecting the automotive fluid to be dispensed from the plurality of automotive fluids, and to accept the second operator input quantifying an amount of the selected automotive fluid to be dispensed; and a control circuit to control the pump assembly so as to dispense the amount of the selected automotive fluid.

6. The system of claim 1, wherein:

one of the plurality of pumps in the pump assembly is driven when the dispensing system is in a dispense mode so that automotive fluid from the selected supply line is transferred to the dispensing gun; and the pump assembly is not driven when the dispensing system is in a non-dispense mode.

7. The system of claim 1, further comprising:

a sensor coupled to the trigger assembly to detect the operator input to activate the pump assembly by depressing the trigger assembly.

8. The system of claim 1, further comprising a transport tube provided between the plurality of check valves and the lower check valve.

9. The system of claim 1, wherein the lower check valve includes an upper element coupled to the outlet, a lower element coupled to the upper element, a plunger protruding from the lower element and a spring that forces the lower check valve to a closed configuration.

* * * * *